US007306451B2

(12) United States Patent
Kruger et al.

(10) Patent No.: US 7,306,451 B2
(45) Date of Patent: Dec. 11, 2007

(54) FORMING TOOL APPARATUS WITH PIVOTING WALL SEGMENT

(75) Inventors: Gary A. Kruger, Troy, MI (US); Mark G. Konopnicki, Rochester, MI (US); John E. Carsley, Clinton Township, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 197 days.

(21) Appl. No.: 11/206,552

(22) Filed: Aug. 18, 2005

(65) Prior Publication Data

US 2007/0039370 A1 Feb. 22, 2007

(51) Int. Cl.
*B29C 45/44* (2006.01)

(52) U.S. Cl. ..... 425/442; 425/556; 425/DIG. 58

(58) Field of Classification Search ..... 425/441, 425/442, 556, DIG. 58
See application file for complete search history.

(56) References Cited

U.S. PATENT DOCUMENTS 2,784,455 A * 3/1957 Pulaski ..... 425/253
3,642,416 A * 2/1972 Miller ..... 425/438
3,753,641 A * 8/1973 Turner et al. ..... 425/451.6
4,005,966 A * 2/1977 Nutting ..... 425/532
4,101,256 A * 7/1978 White et al. ..... 425/441
5,037,289 A * 8/1991 Ohta et al. ..... 425/532
6,454,554 B1 * 9/2002 Lopez et al. ..... 425/28.1

* cited by examiner

*Primary Examiner*—Yogendra N. Gupta
*Assistant Examiner*—Emmanuel S Luk

(57) ABSTRACT

An improved forming tool apparatus for forming an article having a negative draft angle that locks the formed article within the forming tool. First and second forming tools are closed relative one another to define a forming tool cavity in which the article is formed and opened for removal of the formed article from the forming tool cavity. The first forming tool has a removable cavity wall segment having an undercut cavity wall that provides a desired shape to the formed article but locks the formed article against removal from the forming tool cavity. A pivot linkage normally establishes the removable wall segment in a forming position in which the undercut wall is poised for forming of the article and selectively pivots the removable wall segment out of the forming position when the forming tools are opened so that the undercut wall is pivotally lifted and releases the formed article for removal from the cavity.

18 Claims, 4 Drawing Sheets

FORMING TOOL APPARATUS WITH PIVOTING WALL SEGMENT

FIELD OF THE INVENTION

The present invention relates to a forming tool for making a formed article and more particularly to a forming tool apparatus for the forming of a sheet article having a negative draft angle that locks the formed article within the forming tool.

BACKGROUND OF THE INVENTION

It is well known to form manufactured articles within a forming tool or that includes a first forming tool and a second forming tool that define a cavity there between in the shape of the finished article. The forming tools are typically mounted in a press with one forming tool being stationary and the other forming tool being movable between a closed position in which the forming tool cavity is defined and an open position so that the finished article can be removed from the forming tool. Many types of forming processes are known. For example the finished article may be molded of a fluid plastic material that is injected or blown or vacuumed into the forming tool, or molded of a sheet of plastic material that is compressed or blown or vacuumed into the forming tool. Or the finished article may be formed of a sheet of preheated metal that is blown or vacuumed into the forming tool.

It is the norm in the design of formed articles to design the article so that the forming tool that is used to form the article will have forming tool walls that extend at a positive draft angle that ensure ease of removal of the finished article from the forming tool. However, in many instances this would compromise the desired shape of the finished formed article and it is therefore necessary to design the formed article with more complex shapes that require that the forming tool have a negative draft angle by undercutting a wall of the forming tool cavity. In this case the finished article is locked within the forming tool and cannot be removed. Thus it is known to mount a segment of the forming tool on a slide mechanism so that after the article is formed, the wall segment of the forming tool can be linearly withdrawn away from the formed article to unlock the formed article for removal from the cavity.

SUMMARY OF THE INVENTION

An improved forming tool apparatus is provided for forming an article having a negative draft angle that locks the formed article within the forming tool. A first forming tool and a second forming tool are closed relative one another to define a forming tool cavity in which the formed article is formed and are opened relative one another for removal of the formed article from the forming tool cavity. The first forming tool has a removable cavity wall segment having a draft angle defining an undercut cavity wall that provides a desired shape to the formed article but locks the formed article against removal from the forming tool cavity. A linkage normally establishes the removable wall segment in a forming position in which the undercut wall is poised for forming of the formed article there against and selectively pivots the removable wall segment out of the forming position when the forming tools are opened relative one another so that the undercut wall is pivotally lifted into a position that releases the formed article for removal from the cavity.

Further areas of applicability of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of a particular embodiment is exemplary in nature and is in no way intended to limit the invention, its application, or uses.

Figure 1:
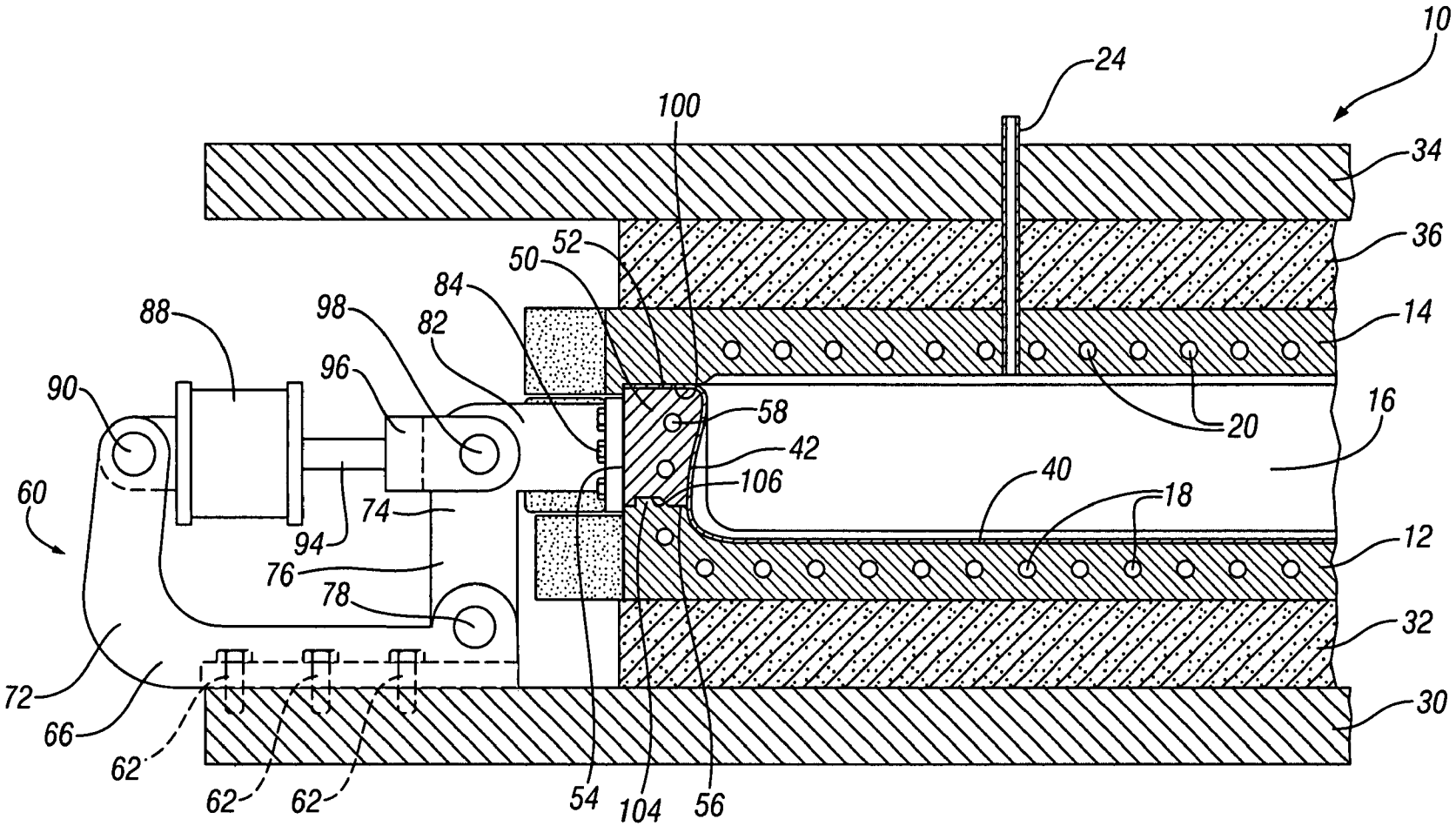
FIG. 1 is a section view taken through a forming tool apparatus of the invention.

Referring to FIG. 1, there is shown a forming apparatus 10 including a lower forming tool 12 and an upper forming tool 14 that are closed relative one another to define a forming tool cavity 16. The particular forming tool shown in FIG. 1 is for the forming of a sheet of heated metal in a process commonly known as superplastic forming or quick plastic forming. Accordingly the forming tools 12 and 14 have heating elements 18 and 20 embedded therein to maintain the temperature of a preheated sheet metal blank that will be draped across the lower forming tool when the forming tools 12 and 14 are in open positions relative one another. The upper forming tool 14 has a gas inlet 24 through which high pressure gas will be introduced after the upper forming tool 14 is lowered onto the lower forming tool 12 to force the preheated sheet metal blank into contact with the lower forming tool 12.

The lower forming tool 12 is mounted on a stationary base plate 30 of a press by a load bearing insulation 32 that insulates the heated lower forming tool 12 from the base plate 30. The upper forming tool 14 is mounted on a vertically movable base plate 34 of the press by a load bearing insulation 36. The press itself is not shown, but may be a hydraulic press or other conventional press known in the industry.

Figure 2:
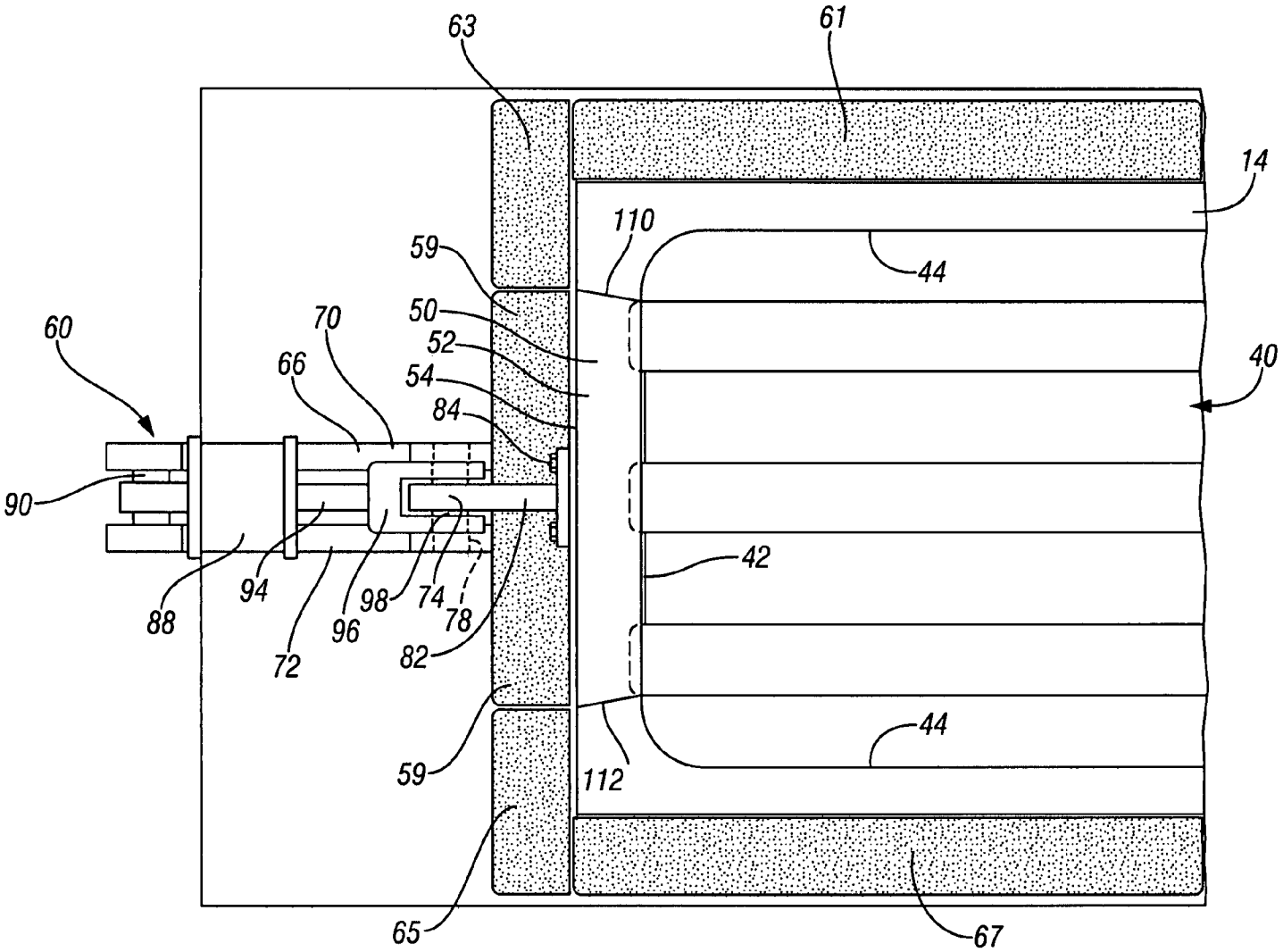
FIG. 2 is a plan view of the lower forming tool of the forming tool apparatus.
Figure 5:
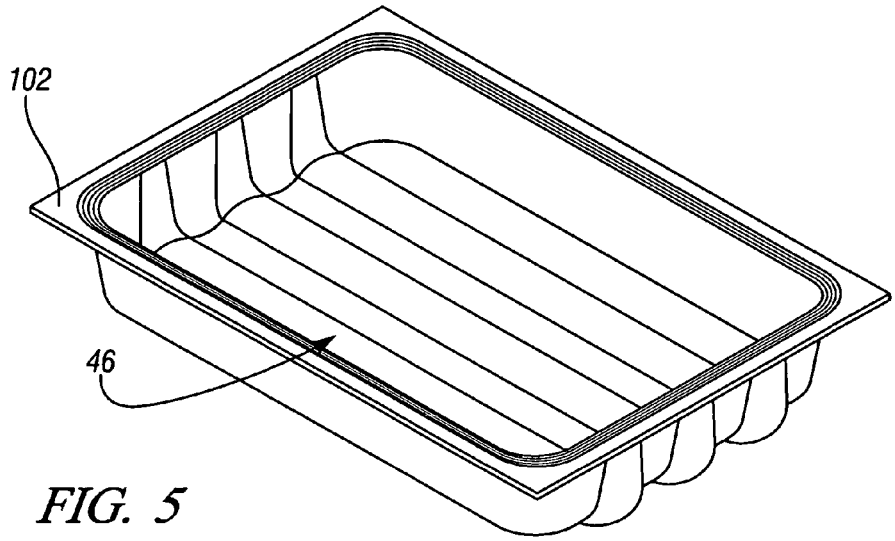
FIG. 5 is a perspective view of the finished formed article.

As seen in FIGS. 1 and 2, the lower forming tool 12 has a bottom cavity wall 40, an end cavity wall 42 and a side cavity wall 44 that cooperate to receive the sheet metal blank when the high pressure gas is introduced through the gas inlet 24 of the upper forming tool 14. As seen in FIG. 1, the end cavity wall 42 is undercut at a negative back angle that is provided so as to form the metal blank into the desired final shape of the tub shaped formed article 46, as seen in FIG. 5. However, as seen in FIG. 1, the effect of this negative back angle of end wall 42 of the formed article 46 is that the article is locked in the lower forming tool 12.

Referring again to FIGS. 1 and 2, it is seen that the lower forming tool 12 includes a removable forming tool wall segment 50 that provides the end cavity wall 42. The wall segment 50 also has a top wall 52, an outside wall 54, and a bottom wall 56. Heating elements 58 are provided in the wall segment 50 and an insulating material 59 is mounted on the outside wall 54 of the end segment 50. FIG. 2 also shows additional blocks of insulating material 61, 63, 65, and 67 to retain heat in the heated lower forming tool 12. Similar blocks of insulating material are attached to and surround the upper forming tool 14.

Figure 3:
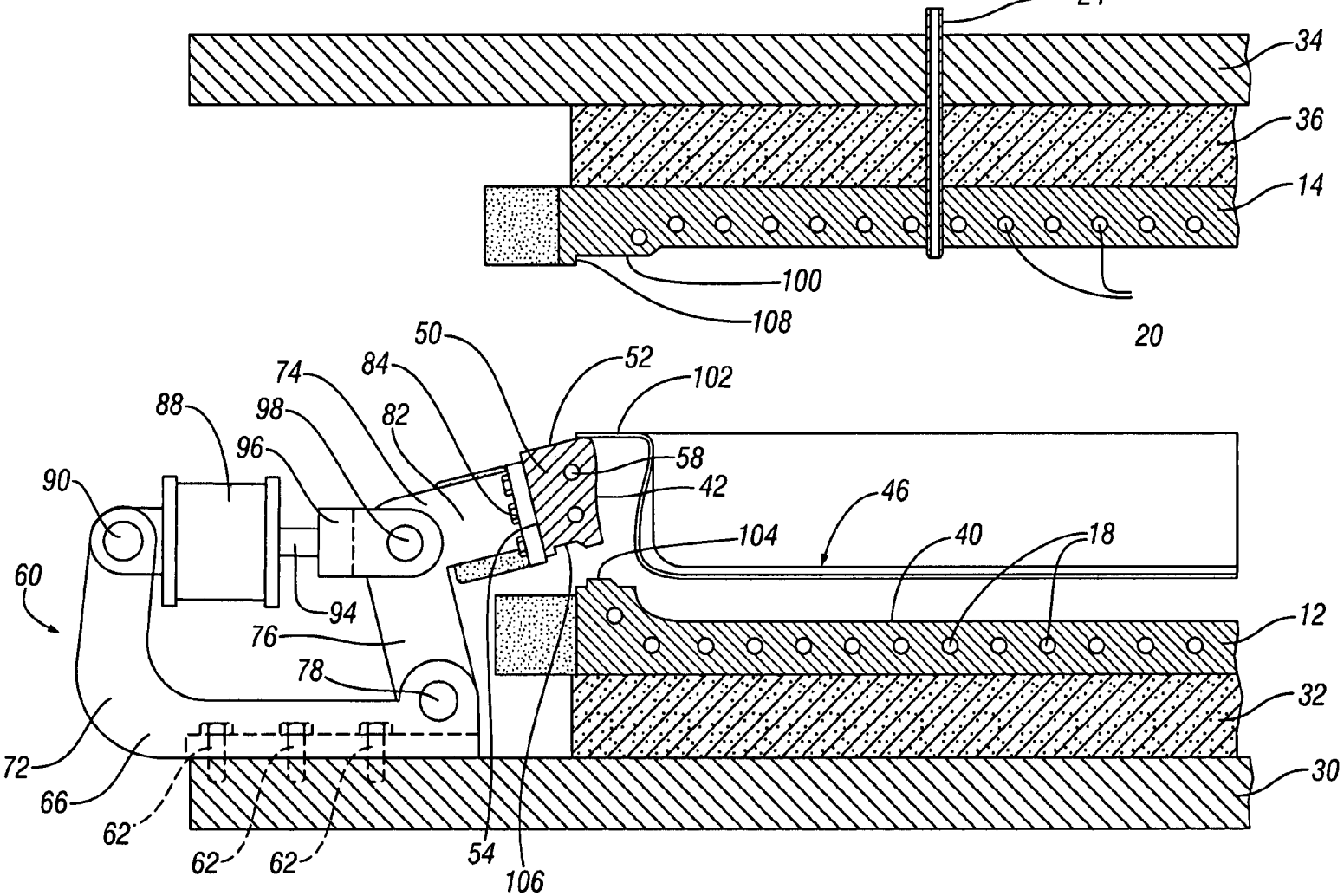
FIG. 3 is a section view similar to FIG. 1 but showing the forming tool apparatus in an open position to permit removal of the formed article from the forming tool apparatus.

Referring to FIGS. 1, 2, 3, and 4, it is seen that the removable wall segment 50 is connected to a linkage assembly, generally indicated at 60, for moving the wall segment 50 from the closed position FIG. 1 to an open position of FIG. 3. A mounting bracket 66 is attached to the lower base plate 30 by bolts 62, and, as shown in FIG. 2, has a pair of spaced apart arms 70 and 72. A pivot link 74 has a lower end 76 that is journalled between the arms 70 and 72 by a pivot shaft 78. The upper end 82 of the pivot link 74 is attached to the removable end segment 50 by bolts 84. A hydraulic cylinder 88 is connected to the arms 70 and 72 of the mounting bracket by a pivot pin 90. The hydraulic cylinder 88 has a shaft 94 that is connected to the pivot link 74 by a clevis 96 and pivot pin 98.

As seen in FIG. 3, after the upper forming tool 14 has been raised away from the lower forming tool 12, the hydraulic cylinder 88 is actuated to pivot the pivot link 74 in an arcuate path away from the lower forming tool 12, which in turn pivotally lifts the removable wall segment 50 upwardly in an arcuate non-linear bodily shifting path that carries the end cavity wall 42 away from the locking condition with the formed article 46. In addition, it will be seen that the upper forming tool 14 has a recessed wall 100 that extends above and is spaced from the top wall 52 of the removable wall segment 50 to define a cavity between the top wall of the removable wall segment 50 and the second forming tool. The formed article 46 has a lip portion 102 that overlies the removable wall segment 50. Accordingly, the upward pivoting and lateral shifting of the wall segment 50 will also remove the formed article 46 at least part way out of the cavity of the lower forming tool 12. The lip 102 may be an intended part of the final finished article, or the lip 102 may be flash that will be trimmed from the formed article in a trimming operation.

Referring again to FIG. 1 and the closed position of the wall segment 50, it is seen that the lower forming tool 12 has an upward extending key 104 and the wall segment 50 has a keyway channel 106 that are interlocked. In addition, the upper forming tool 14 has a shoulder 108 that interlocks with the top wall 52 and the outside wall 54 of the wall segment 50. In this way the wall segment 50 is anchored to the lower forming tool 12 and the upper forming tool 14 to anchor the wall segment 50 against movement by the force imposed thereon by the gas pressure that is introduced into the forming tools during the forming process. It will be appreciated that when the upper forming tool 14 is raised, and when the wall segment 50 is pivoted upwardly and shifted outwardly, this interlocking is terminated, and then is automatically reestablished when the wall segment is pivotally lowered and the upper forming tool 14 is lowered. This interlocking arrangement could be provided by pins or other types of automatically engaging and disengaging interlocks that a person of ordinary skill could substitute. For example interlocking arrangements of this type would be typically provided by a pin or key or similar structure that projects from one of either the forming tools or the wall segment, and a mating hole structure or key way or similar recess in the other forming tool, with these structures sized and angled so as to interlock the removable wall segment tightly in place when the forming tools are closed, but enable un-interlocking when the wall segment 50 is withdrawn along a non linear path defined by a linkage mechanism.

Referring again to FIG. 2, it will be seen that the wall segment 50 of the lower forming tool 12 has end walls 110 and 112, that are angled somewhat so that the cavity wall 42 of the wall segment 50 is narrower than the outer wall 54. Thus, when the wall segment is in its forming position of FIG. 1, the end walls will interact with the adjoining tapered walls of the lower forming tool 12 to interlock the wall segment 50 in the forming tool 12 and restraint the wall segment against movement by the gas pressure introduced into the forming tool. Furthermore FIG. 4 shows that the end walls 110 and 112 are also angled somewhat from top to bottom so that the wall segment 50 is narrower at its bottom wall 56 than at its top wall 52 so as to facilitate its release from the lower forming tool 12 when the linkage mechanism 60 is actuated.

Figure 4:
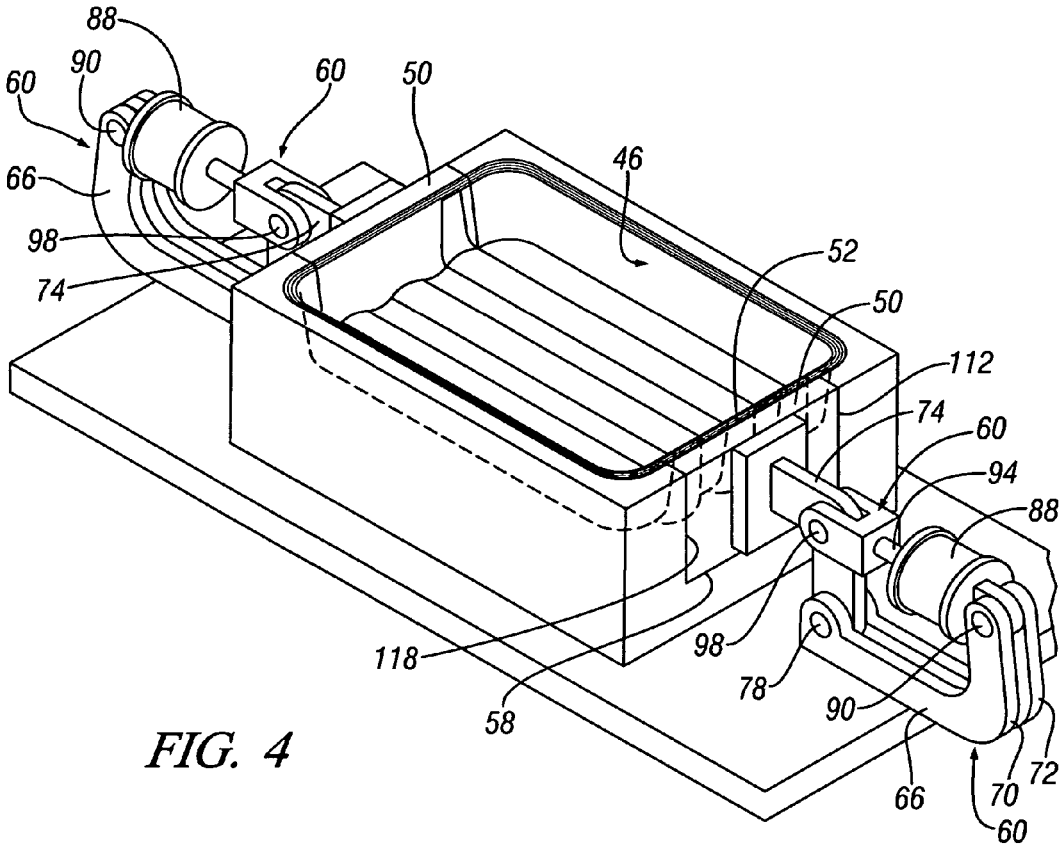
FIG. 4 is a perspective view showing the lower forming tool prior to removal of the formed article.

As seen in FIG. 4, movable wall segments 50 and linkage mechanisms 60 are provided at each end of the forming tool apparatus. It will be understood that additional movable segments may be provided at desired locations, depending upon the desired shape of the formed article. In addition, the removable wall segments can be provided in both the upper and lower forming tools.

The description of the invention is merely exemplary in nature and, thus, variations thereof are intended to be within the scope of the invention. The hydraulic cylinder can be any type of known actuator, for example, a pneumatic cylinder, or a servo electric motor, or a gravity activated mechanism controlled by the motion of the press. For example, the invention is not limited to use in the forming of preheated sheet metal panels, as disclosed herein, but may be employed in other forming process apparatus such as injection molding, blow molding, compression molding, vacuum molding, hydro forming, and other known molding and forming process apparatus. Accordingly the use of the term forming tool is intended to encompass the full range of molds, dies, tools and the like that are used in these various forming processes.

What is claimed is:

1. A forming tool apparatus for forming an article having a negative draft angle that locks the formed article within the forming tool, comprising:

a first forming tool and a second forming tool that are closed relative to one another to define a forming tool cavity in which the formed article is formed and are opened relative to one another for removal of the formed article from the forming tool cavity;

the first forming tool having a removable wall segment having a draft angle defining an undercut cavity wall that provides a desired shape to the formed article but locks the formed article against removal from the forming tool cavity;

a linkage normally establishing the removable wall segment in a forming position in which the undercut wall is poised for forming of the formed article there against and selectively pivoting the removable wall segment out of the forming position when the forming tools are opened relative one another so that the undercut wall is pivotally lifted into a position that releases the formed article for removal from the cavity, and said removable wall segment and first forming tool carrying interlocking structures that self engage with one another when the removable wall segment is in the forming position so that the removable wall segment is retained in forming position independent of the linkage and to self disengage from one another when the removable wall segment is pivoted out of the forming position.

2. The forming tool apparatus of claim 1 in which the linkage acts to simultaneously vertically lift the removable wall segment away from the first forming tool and withdraw the removable wall segment laterally away from the first forming tool.

3. The forming tool apparatus of claim 1 in which the removable wall segment of the first forming tool and the second forming tool have interlocking structures that self engage with one another upon closure of the second forming tool upon the first forming tool to retain the removable wall segment in forming position independent of the linkage and to self disengage from one another upon opening of the other forming tool from the one forming tool.

4. The forming tool apparatus of claim 1 in which the linkage includes a pivot link having a first end attached to the removable wall segment and a second end pivotally mounted relative the first forming tool so that pivoting of the pivot link swings the removable wall segment upwardly and outwardly from the first forming tool.

5. The forming tool apparatus of claim 1 in which the removable wall segment has an upper wall that is spaced from the second forming tool when in the forming position to define there between a forming tool cavity that forms an integral lip onto the formed article, said formed lip overlying the removable wall segment so that the pivoting of the removable wall segment lifts the formed article at least partially out of the first forming tool when the removable wall segment is pivoted.

6. The forming tool apparatus of claim 1 in which the linkage is actuated by a hydraulic cylinder.

7. A forming tool apparatus for forming an article having a negative draft angle that locks the formed article within the forming tool, comprising:

a first forming tool and a second forming tool that are closed relative to one another to define a forming tool cavity in which the formed article is formed and are opened relative to one another for removal of the formed article from the forming tool cavity;

the first forming tool having a removable wall segment having a draft angle defining an undercut cavity wall that provides a desired shape to the formed article but locks the formed article against removal from the forming tool cavity;

a pivot link having a first end defining a pivot arc for the pivot link and a second end that is attached to the removable wall segment so that pivoting of the pivot link will swing the removable wall segment in a bodily shifting manner that withdraws the undercut cavity wall along a nonlinear path that unlocks the formed article for removal from the forming tool; and, interlocking structure provided between the removable wall segment and at least one of the forming tools to self engage with one another when the removable wall segment is in the forming position so that the removable wall segment is retained in the forming position independent of the pivot link and to self disengage from one another when the removable wall segment is pivoted out of the forming position.

8. The forming tool apparatus of claim 7 in which the interlocking structure is provided respectively on the second forming tool and the removable wall segment to lock the removable wall segment against movement by the forming pressure imposed thereon during the forming process, but upon the bodily shifting movement of the removable wall segment the interlocking structure releases.

9. The forming tool apparatus of claim 8 in which the interlock is a shoulder that extends from the second forming tool and engages with the removable wall segment to lock the removable wall segment.

10. The forming tool apparatus of claim 7 in which the interlocking structure is provided respectively on the first forming tool and the removable wall segment to lock the removable wall segment against movement by the forming pressure imposed thereon during the forming process, but upon the bodily shifting movement of the removable wall segment the interlocking structure releases.

11. The apparatus of claim 10 in which the interlock structure is a key that extends from one of the removable wall segment and the first forming tool and a keyway channel that is provided in the other of the removable wall segment and the first forming tool.

12. The forming tool apparatus of claim 7 in which the removable wall segment has an upper wall that is spaced from the second forming tool when in the forming position to define there between a forming tool cavity that forms an integral lip onto the formed article, said forming tool cavity that forms the integral lip overlying the removable wall segment so that the pivoting of the removable wall segment lifts the formed article at least partially out of the first forming tool when the removable wall segment is pivoted upwardly.

13. The forming tool apparatus of claim 7 in which a fluid pressure actuated cylinder is connected to the pivot link for pivoting the pivot link.

14. A forming tool apparatus for forming an article within a first forming tool and a second forming tool that are closed relative to one another to define a forming tool cavity in which the formed article is formed, and are opened relative to one another for removal of the formed article from the forming tool cavity;

the first forming tool having a cavity formed therein defined in part by a forming tool wall segment that is separate and removable from the first forming tool, said forming tool wall segment having a cavity defining undercut wall thereof extending at a negative draft angle that provides a desired shape to the formed article but locks the formed article against removal from the first forming tool when the second forming tool is opened relative to the first forming tool;

a pivot link having a first end defining a pivot arc for the pivot link and a second end that is attached to the removable forming tool wall segment so that pivoting of the pivot link will swing the removable forming tool wall segment in a bodily shifting manner that withdraws the undercut cavity wall along a nonlinear path that unlocks the formed article for removal from the first forming tool;

an actuator for pivoting the pivot link;

and at least one interlocking structure independent of the pivot link and actuator provided between the removable forming tool wall segment and one of the forming tools to hold the removable forming tool wall segment against movement by the forming pressure imposed thereon during the forming process.

15. The forming tool apparatus of claim 14 in which the actuator is a hydraulic cylinder.

16. The forming tool apparatus of claim 14 in which the removable forming tool wall segment has an upper wall that is spaced from the second forming tool when in the forming position to define there between a forming tool cavity that forms an integral lip onto the formed article, said formed lip overlying the removable forming tool wall segment so that the pivoting of the removable forming tool wall segment lifts the formed article at least partially out of the first forming tool when the removable forming tool wall segment is pivoted upwardly.

17. The forming tool apparatus of claim 14 in which the interlocking structure is provided respectively on the second forming tool and the removable forming tool wall segment to lock the removable forming tool wall segment against movement by the forming pressure imposed thereon during the forming process, but upon the bodily shifting movement of the removable forming tool wall segment the interlocking structure releases.

18. The forming tool apparatus of claim 14 In which the interlocking structure is provided respectively on the first forming tool and the removable forming tool wall segment to lock the removable forming tool wall segment against movement by the forming pressure imposed thereon during the forming process, but upon the bodily shifting movement of the removable forming tool wall segment the interlocking structure releases.

* * * * *